US007918429B1

(12) United States Patent
Kleespie

(10) Patent No.: US 7,918,429 B1
(45) Date of Patent: Apr. 5, 2011

(54) HORIZONTAL FUEL TANK SUPPORT SYSTEM

(76) Inventor: Bruce Kleespie, Portage, WI (US)

( * ) Notice: Subject to any disclaimer, the term of this patent is extended or adjusted under 35 U.S.C. 154(b) by 570 days.

(21) Appl. No.: 12/034,682

(22) Filed: Feb. 21, 2008

(51) Int. Cl.
*A47B 91/00* (2006.01)

(52) U.S. Cl. ..... 248/346.01; 248/311.2; 248/903; 248/146; 220/571; 220/572

(58) Field of Classification Search ..... 248/677, 248/346.01, 346.02, 346.5, 346.03, 311.2, 248/903, 146, 523, 116; 52/27, 98, 99, 299, 52/169.9; 220/571, 572
See application file for complete search history.

(56) References Cited

U.S. PATENT DOCUMENTS

| | | | | | |
|---|---|---|---|---|---|
| 1,525,242 | A | * | 2/1925 | Jagschitz | 52/126.7 |
| 4,023,755 | A | * | 5/1977 | Alesi, Jr. | 248/678 |
| 4,212,446 | A | * | 7/1980 | Domanick et al. | 248/678 |
| 4,315,561 | A | * | 2/1982 | Partridge | 184/106 |
| 4,393,999 | A | * | 7/1983 | Forshee | 248/346.02 |
| 4,838,176 | A | * | 6/1989 | Bowser et al. | 108/53.3 |
| 4,869,456 | A | * | 9/1989 | Jacobs | 248/678 |
| 4,998,696 | A | * | 3/1991 | Desjardins | 248/146 |
| 5,330,071 | A | * | 7/1994 | Parker | 220/645 |
| 5,368,263 | A | * | 11/1994 | Harrison | 248/146 |
| 5,419,524 | A | * | 5/1995 | Evans et al. | 248/346.4 |
| D370,757 | S | * | 6/1996 | Loftus et al. | D34/23 |
| 5,580,022 | A | * | 12/1996 | Bach et al. | 248/346.01 |
| D390,314 | S | * | 2/1998 | Chen | D34/23 |
| 5,961,093 | A | * | 10/1999 | Jones et al. | 248/678 |
| 6,135,410 | A | * | 10/2000 | Harrison | 248/346.01 |
| 6,170,788 | B1 | * | 1/2001 | Stevenson | 248/346.01 |
| 6,216,990 | B1 | * | 4/2001 | Harrison | 248/146 |
| 6,886,787 | B2 | * | 5/2005 | Stahl | 248/129 |
| 7,222,823 | B2 | * | 5/2007 | Thomas et al. | 244/173.2 |
| 2005/0247851 | A1 | * | 11/2005 | Kessler et al. | 248/678 |
| 2007/0187564 | A1 | * | 8/2007 | McGuire | 248/346.5 |
| 2009/0134301 | A1 | * | 5/2009 | Dysinger et al. | 248/346.01 |

OTHER PUBLICATIONS

WB Sales, Inc., "Dandi Block", <retrieved from http://www.wbsales.net/dandi/dandi.asp2/8/2008>. Date of first publication is believed to be prior to Feb. 1, 2007.

* cited by examiner

*Primary Examiner* — Kimberly T Wood
(74) *Attorney, Agent, or Firm* — Neustel Law Offices

(57) ABSTRACT

A horizontal fuel tank support system for efficiently supporting a propane tank above the ground. The horizontal fuel tank support system generally includes a support pad including an internal cavity, wherein the internal cavity extends throughout the support pad and wherein the support pad is comprised of an elongated configuration, a platform defining at least a portion of an upper surface of the elongated support pad, wherein the platform extends along a longitudinal axis of the elongated support pad, and an internal ribbing structure extending within the internal cavity and beneath the platform. The internal ribbing structure includes a plurality of outer ribbing portions and an inner ribbing portion, wherein the inner ribbing portion is connected between the plurality of outer ribbing portions. The inner ribbing portion is comprised of a less dense structure than the plurality of outer ribbing portions to distribute the weight of the propane tank directly below the legs of the propane tank.

13 Claims, 8 Drawing Sheets

HORIZONTAL FUEL TANK SUPPORT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to propane tank support and more specifically it relates to a horizontal fuel tank support system for efficiently supporting a propane tank above the ground.

2. Description of the Related Art

Any discussion of the related art throughout the specification should in no way be considered as an admission that such related art is widely known or forms part of common general knowledge in the field.

Propane tank supports have been in use for years and are generally utilized to support a propane tank above the ground. Propane tanks are supported above the ground for various reasons, such as to allow the propane tank to be painted, to allow maintenance upon the tank or to simply support the tank above the ground and prevent the tank from sinking within the ground or damaging the ground below.

Generally, concrete blocks are utilized to support the legs of a propane tank to support the tank above the ground. However, concrete blocks can be difficult to utilize for various reasons, such as but not limited to difficulty in moving around because of their weight, cumbersome to carry and fragile in that the concrete blocks may often crack if dropped upon a hard surface.

The prior art has also included preformed supports for propane tanks. However, these preformed supports generally do not include an efficient internal support structure to distribute weight in an efficient manner according to the positioning of the propane tank upon the support. Because of the inherent problems with the related art, there is a need for a new and improved horizontal fuel tank support system for efficiently supporting a propane tank above the ground.

BRIEF SUMMARY OF THE INVENTION

The general purpose of the present invention is to provide a horizontal fuel tank support system that has many of the advantages of the propane tank supports mentioned heretofore. The invention generally relates to a propane tank support which includes a support pad including an internal cavity, wherein the internal cavity extends throughout the support pad and wherein the support pad is comprised of an elongated configuration, a platform defining at least a portion of an upper surface of the elongated support pad, wherein the platform extends along a longitudinal axis of the elongated support pad, and an internal ribbing structure extending within the internal cavity and beneath the platform. The internal ribbing structure includes a plurality of outer ribbing portions and an inner ribbing portion, wherein the inner ribbing portion is connected between the plurality of outer ribbing portions. The inner ribbing portion is comprised of a less dense structure than the plurality of outer ribbing portions to distribute the weight of the propane tank directly below the legs of the propane tank.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a horizontal fuel tank support system for efficiently supporting a propane tank above the ground.

Another object is to provide a horizontal fuel tank support system that is lightweight and easy to maneuver.

An additional object is to provide a horizontal fuel tank support system that may be manufactured to accommodate various size propane tanks.

A further object is to provide a horizontal fuel tank support system that includes an internal ribbing structure to efficiently distribute the weight of the propane tank.

A further object is to provide a horizontal fuel tank support system that properly guides the legs of the propane tank into a secure and desired position.

A further object is to provide a horizontal fuel tank support system that elevates a propane tank far enough off the ground to allow for painting, mowing and trimming around the propane tanks and other maintenance around and upon the propane tank.

A further object is to provide a horizontal fuel tank support system that includes a preformed identifier portion to allow an owner to mark or label a respective horizontal fuel tank support system.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
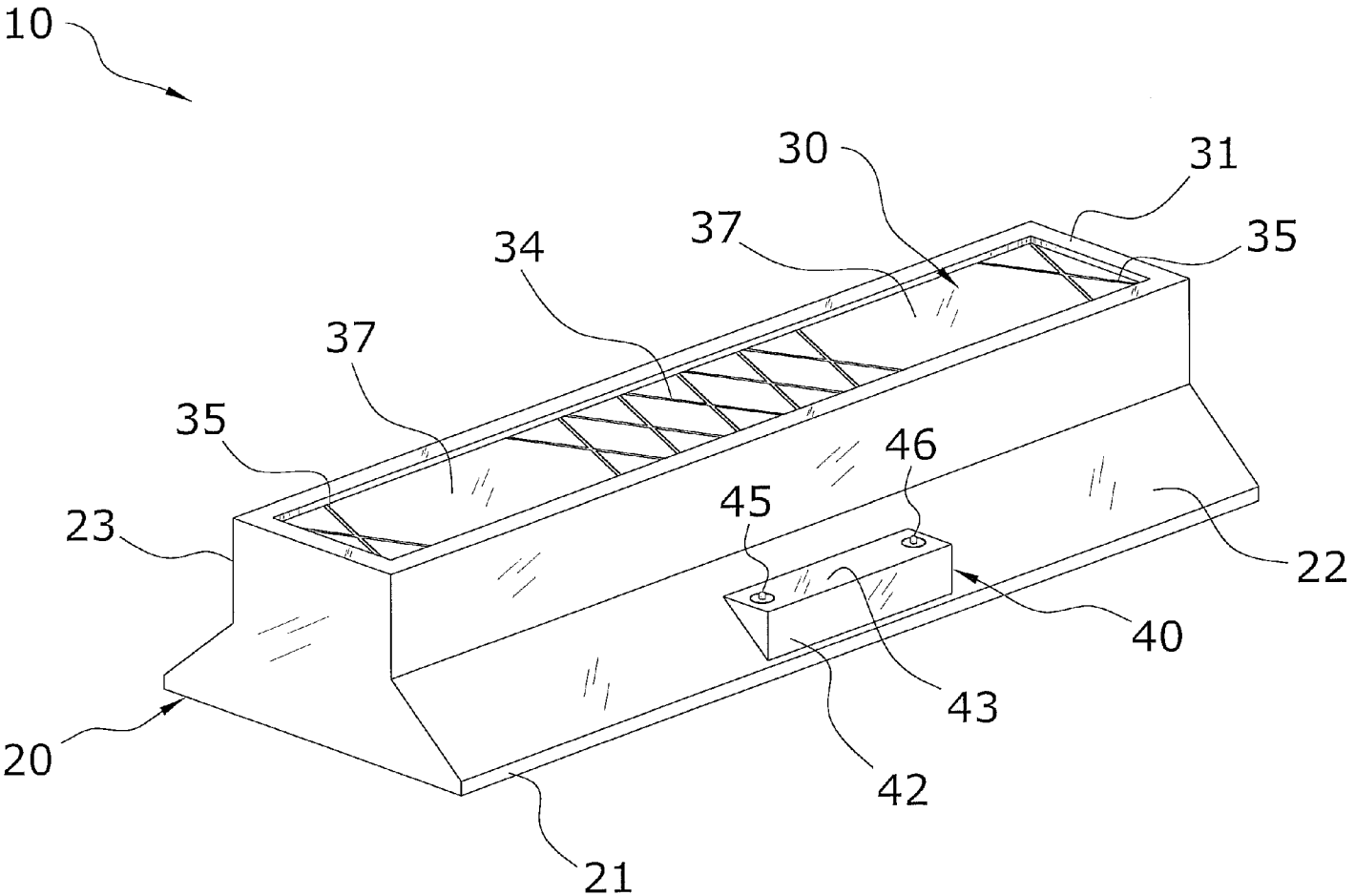
FIG. 1 is an upper perspective view of the present invention.
Figure 2:
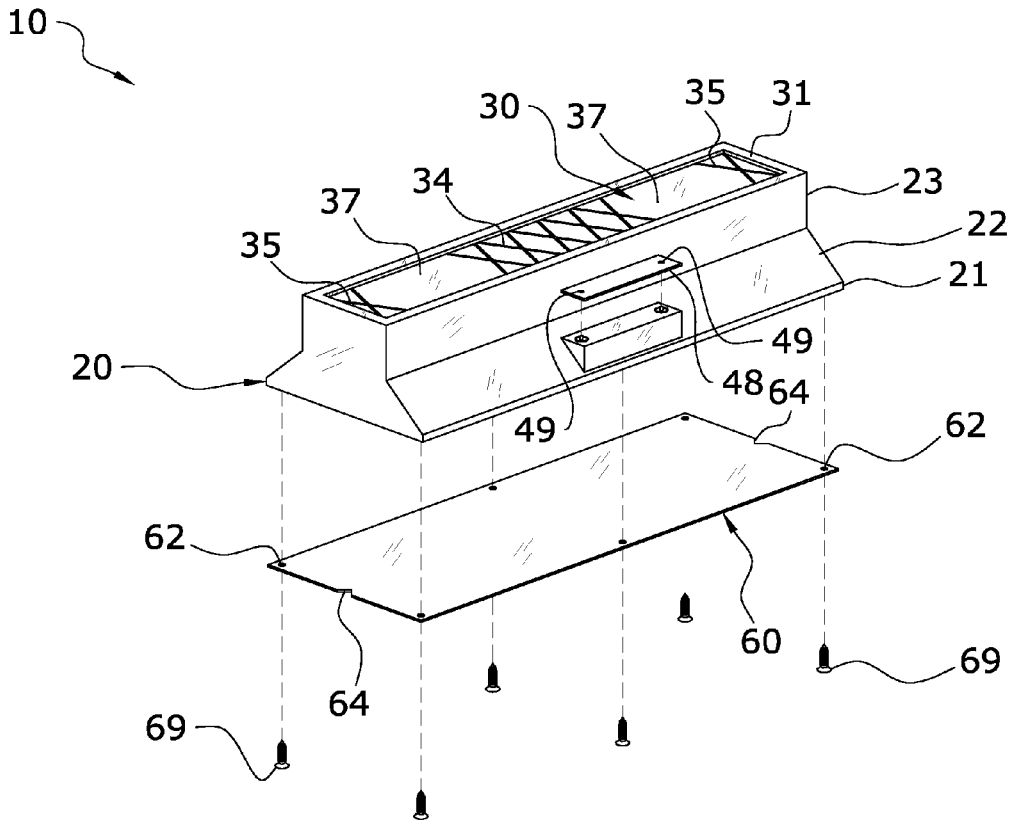
FIG. 2 is an upper perspective view of the present invention with the base exploded from the support pad.
Figure 3:
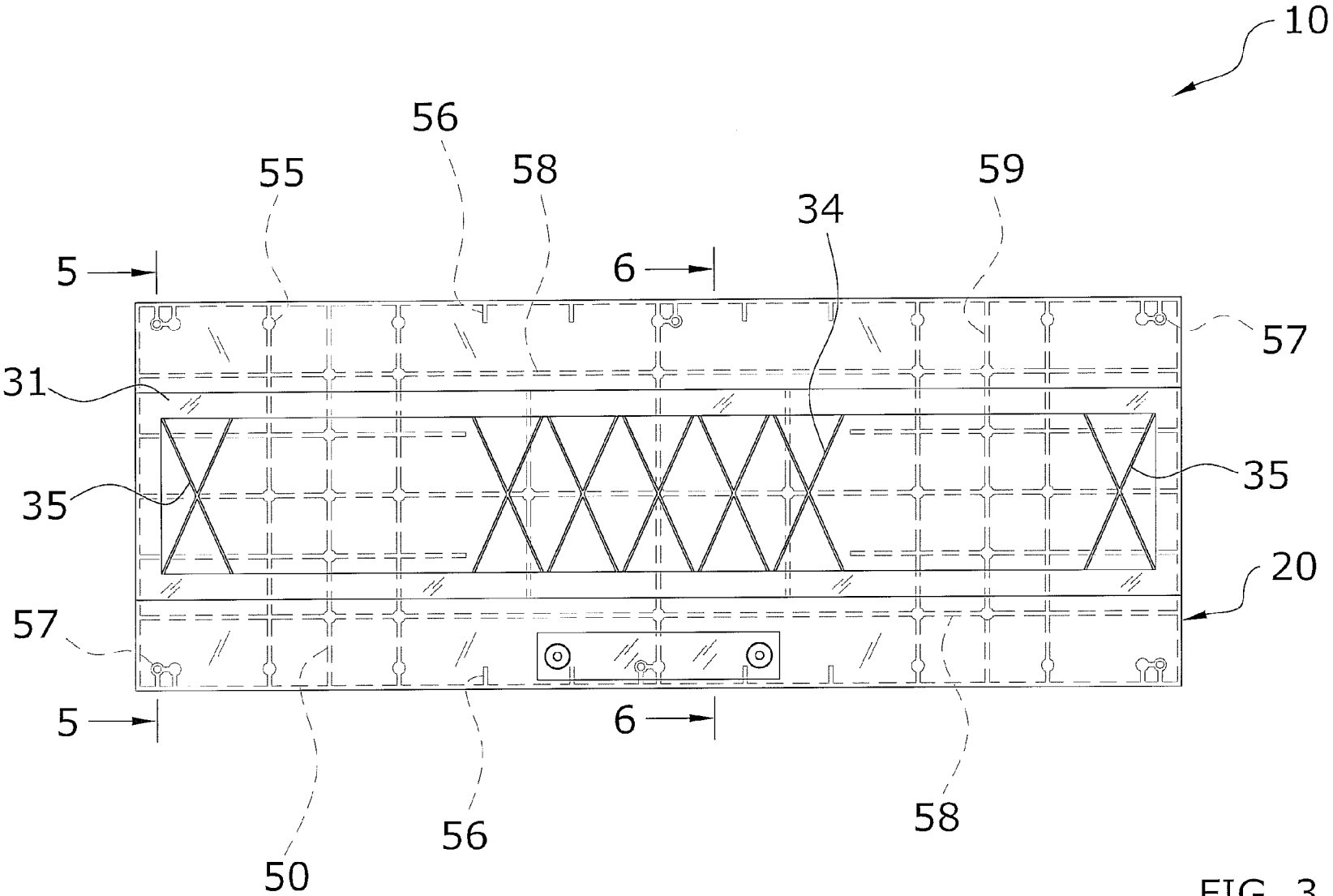
FIG. 3 is a top view of the present invention illustrating the positioning of the internal ribbing structure in relation to the platform.
Figure 4:
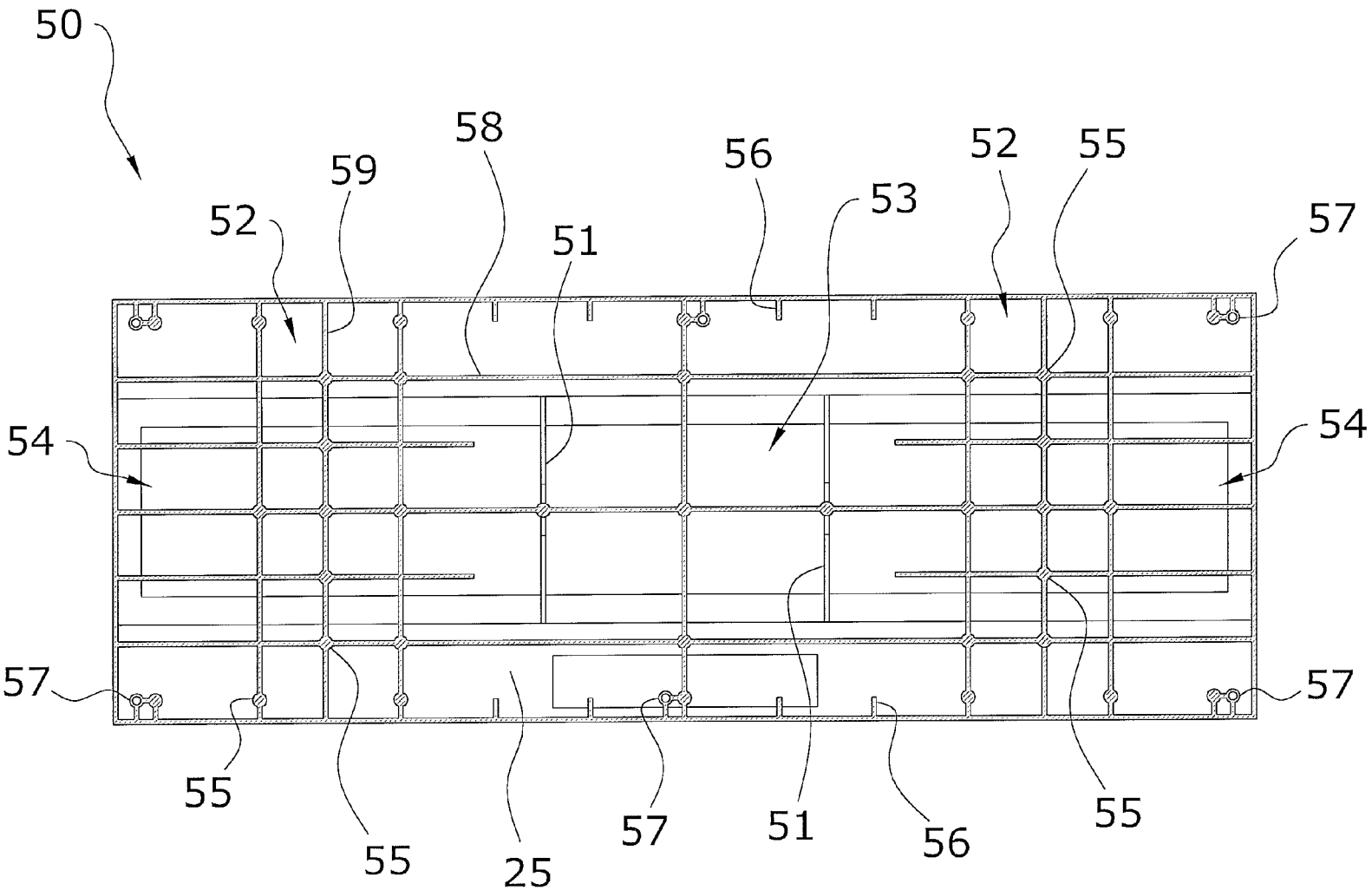
FIG. 4 is a sectional view taken through the lower end of the base portion of the support pad and looking upwards to illustrated the internal ribbing structure.
Figure 5:
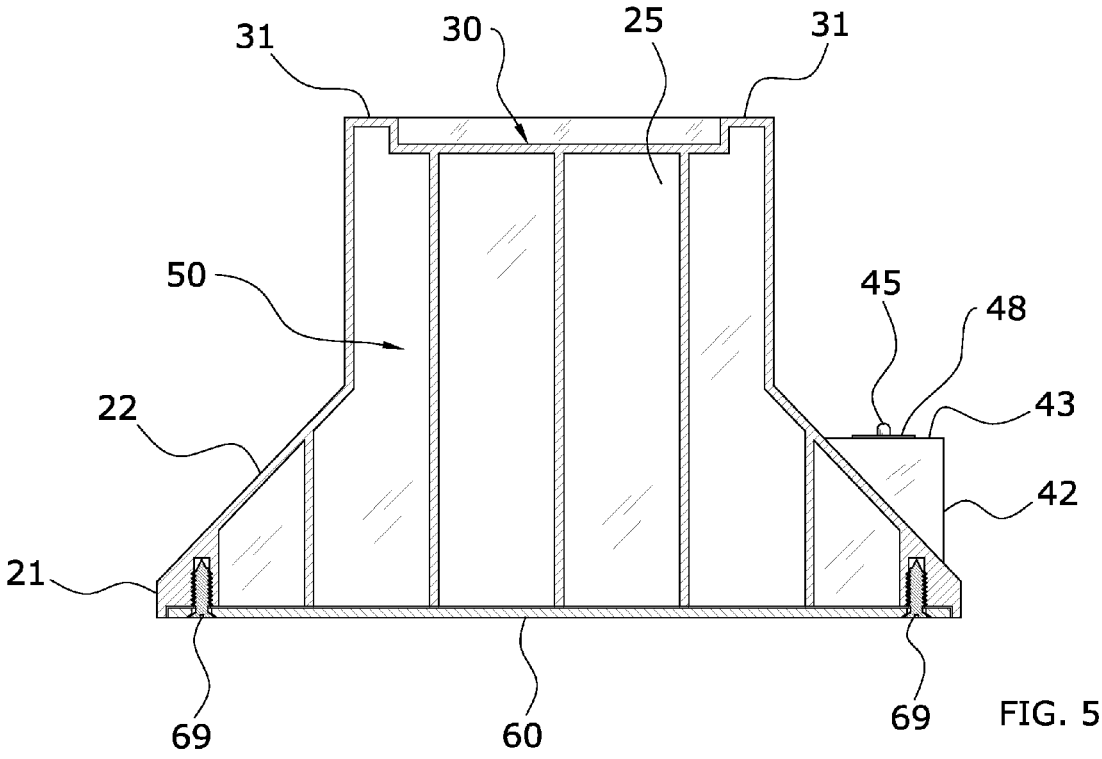
FIG. 5 is a cross-sectional view taken along lines 5-5 of FIG. 3.
Figure 6:
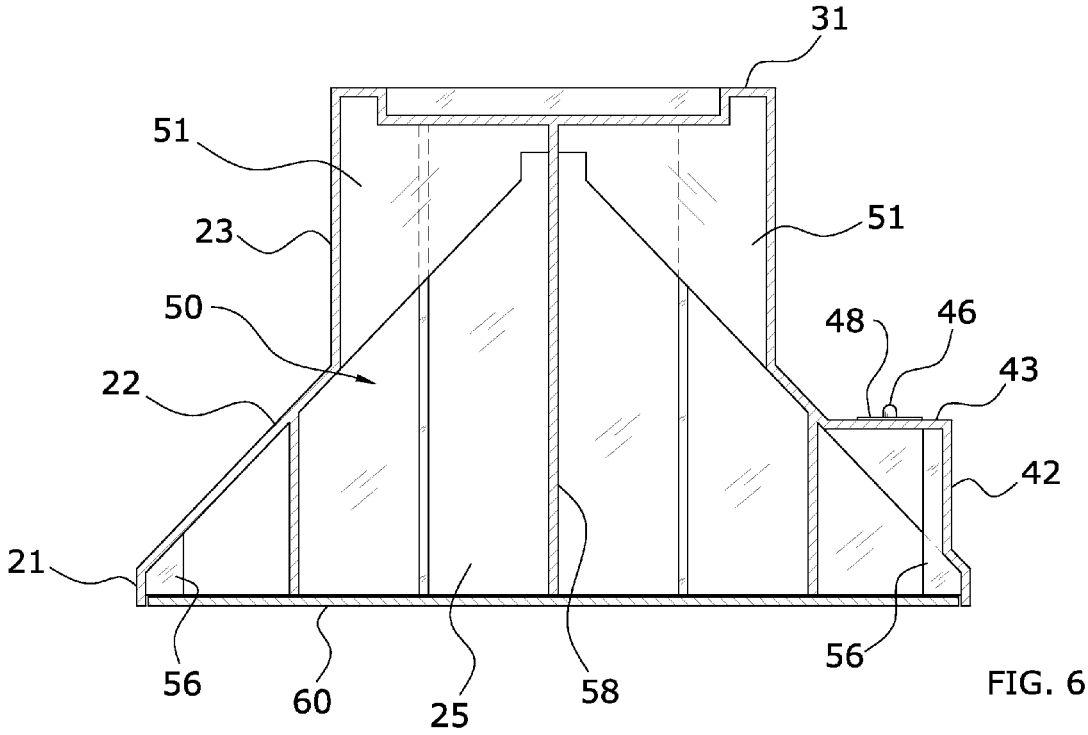
FIG. 6 is a cross-sectional view taken along lines 6-6 of FIG. 3.
Figure 7:
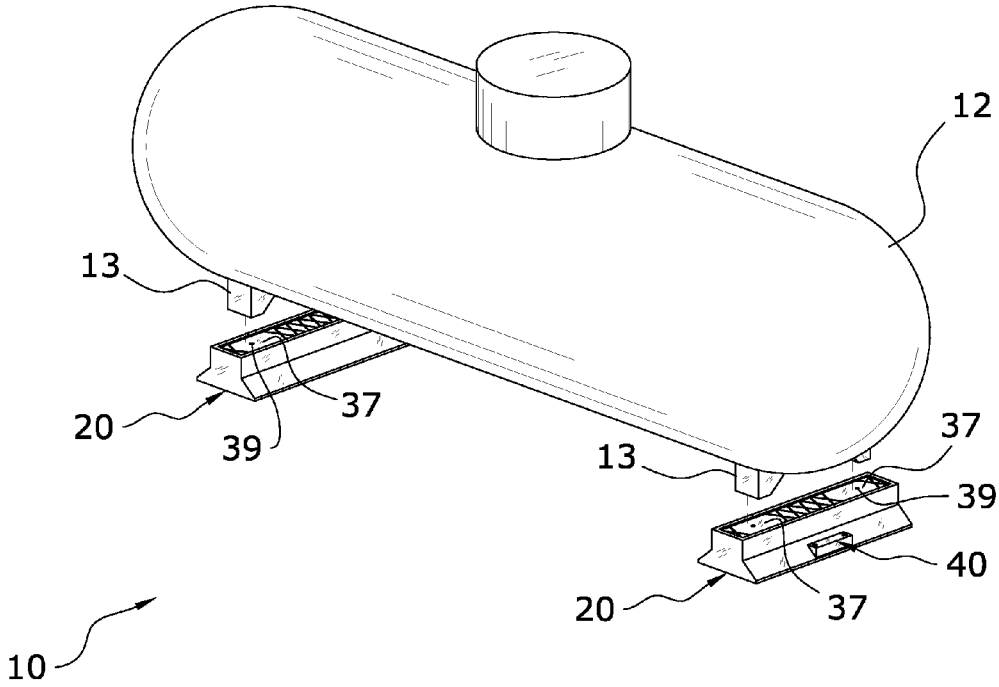
FIG. 7 is an upper perspective view of the present invention with the legs of a propane tank aligned with and exploded from the present invention.
Figure 8:
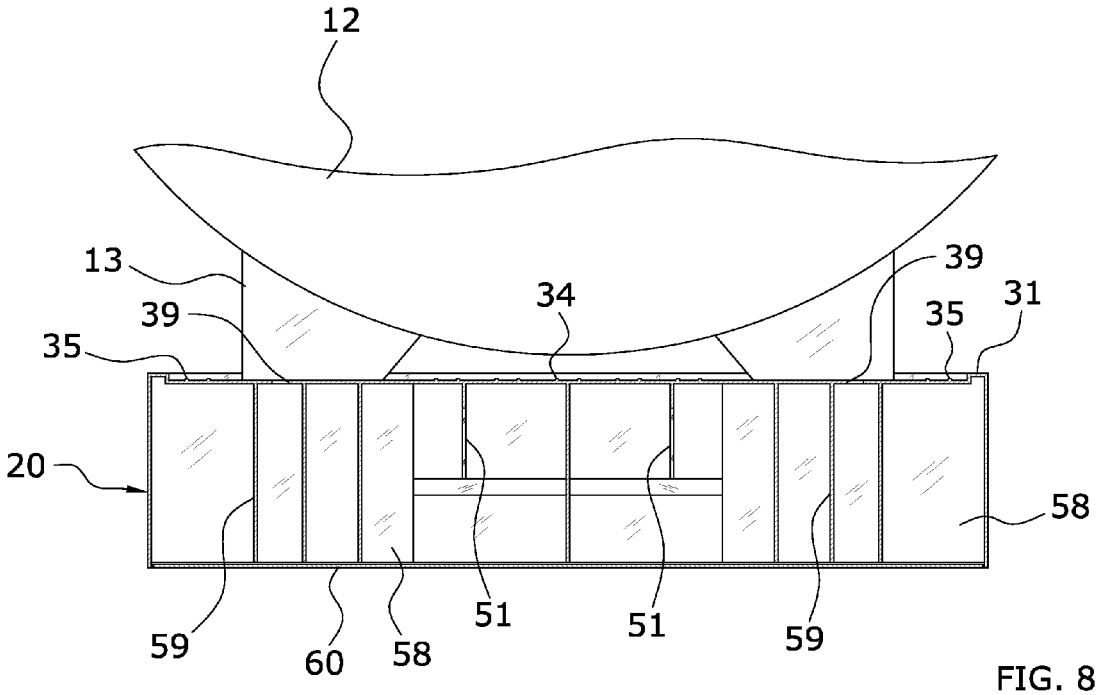
FIG. 8 is a lengthwise sectional view of the present invention illustrating the legs of the propane tank positioned within the receiving portions of the platform.

Turning now descriptively to the drawings, in which similar reference characters denote similar elements throughout the several views, FIGS. 1 through 8 illustrate a horizontal fuel tank support system 10, which comprises an elongated support pad 20 including an internal cavity 25 extending throughout the support pad 20, a platform 30 defining a portion of an upper surface of the elongated support pad 20, wherein the platform 30 extends along a longitudinal axis of the elongated support pad 20 and an internal ribbing structure 50 extending within the cavity 25 and beneath the platform 30.

The internal ribbing structure 50 includes a pair of first outer ribbing portions 52 and a inner ribbing portion 53 interconnected between the first outer ribbing portions 52. The pair of first outer ribbing portions 52 are comprised of a denser structure than the inner ribbing portion 53, wherein the legs 13 of the propane tank 12 are positioned upon the platform 30 directly above the first outer ribbing portions 52 to direct a majority of the amount of weight of the propane tank 12 upon the first outer ribbing portions 52. It is appreciated that although the present invention is described and illustrated as supporting propane tanks 12, the present invention may be utilized to support various other tanks or various other structures rather than propane tanks 12.

B. Support Pad

The support pad 20 is comprised of a rigid and elongated structure to support an end of a propane tank 12. The support pad 20 is preferably positioned under a pair of legs 13 on each end of the propane tank 12, wherein the present invention is preferably utilized with horizontal propane tanks 12 up to and including 1000 pound propane tanks 12. The support pad 20 is also comprised of a strong structure to support the excessive weight of the propane tank 12.

The support pad 20 is further comprised of a material that is substantially weatherproof so as to be left outside at all times and not wear away or corrode. In the preferred embodiment, the support pad 20 is comprised of a virgin plastic material and is molded to shape; however it is appreciated that the support pad 20 may be comprised of various materials and be constructed in various manners. The support pad 20 is further preferably comprised of a trapezoidal structure.

The support pad 20 includes a base portion 21 and an upper portion 23 extending vertically upward from the base portion 21. The base portion 21 is preferably comprised of a wider width than the upper portion 23 so as to provide increased stability for the support pad 20 upon the ground surface. The total height of the base portion 21 and the upper portion 23 is also such that when the propane tank 12 is positioned upon the upper portion 23, an individual is able to mow or trim under and around the propane tank 12 with ease and also paint and perform other maintenance to the lower end of the propane tank 12 with ease. The base portion 21 may also include a tapered portion 22 to taper outwardly from the upper portion 23 and further increase the stability of the support pad 20.

The support pad 20 is also preferably comprised of a hollow structure to allow the present invention to be substantially lightweight so that the present invention may be easily transported, wherein an internal cavity 25 extends within the base portion 21 and the upper portion 23. The internal cavity 25 preferably extends throughout the inside of the base portion 21 and the upper portion 23. An internal ribbing structure 50 is positioned within the internal cavity 25 to provide support for the support pad 20 when the propane tank 12 is positioned upon the support pad 20. The internal ribbing structure 50 also serves to better distribute the weight from the propane tank 12 upon the support pad 20.

C. Platform

The platform 30 extends across and along the longitudinal axis of the upper portion 23 of the support pad 20. The platform 30 receives the legs 13 of the propane tank 12, wherein the platform 30 is preferably a sufficient length to receive a pair of legs 13 on a given end of the propane tank 12. The platform 30 is also preferably completely supported by the base portion 21 and the upper portion 23, wherein the platform 30 does not extend beyond the base portion 21 or the upper portion 23. It is appreciated that the platform 30 may include drainage holes 39 extending through the platform 30 and leading to the internal cavity 25 to prevent water from building up within the sunken platform 30.

A raised edge 31 extends around the perimeter of the platform 30 to prevent the legs 13 from sliding off of the platform 30. The platform 30 is thus sunken with respect to the raised edge 31. The platform 30 is also preferably comprised of a substantially planar configuration to allow the legs 13 of the propane tank 12 to be positioned upon the platform 30 in a stable manner and to prevent the legs 13 from easily sliding or moving when positioned upon the platform 30.

The platform 30 also includes a plurality of guide ridges 34, 35. The guide ridges 34, 35 are preferably raised slightly from the platform 30 and serve as guides so that the legs 13 are evenly positioned upon the platform 30 with respect to a longitudinal axis of the platform 30. The guide ridges 34, 35 preferably include at least one inner guide ridge 34 and a pair of outer guide ridges 35. It is appreciated however that the raised edge 31 may serve as the outer guide ridge 35.

A pair of receiving portions 37 are positioned between the outer guide ridges 35 and the inner guide ridge 34 upon opposing sides of the inner guide ridge 34. The receiving portions 37 are large enough in surface area to individually receive a respective leg 13 of the propane tank 12. The receiving portions 37 are further integral with the platform 30 and comprised of a planar configuration.

In the preferred embodiment, the inner guide ridge 34 and the outer guide ridges 35 are comprised of a raised X-shaped configuration. The platform 30 includes a plurality of inner guide ridge 34 and one outer guide ridge 35 upon each end of the platform 30. It is appreciated that the platform 30 may include more or less guide ridges 34, 35 depending on the size and positioning of the legs 13 of the propane tank 12 upon the platform 30.

D. Identifier Portion

The support pad 20 also preferably includes an identifier portion 40 extending from the support pad 20. The identifier portion 40 preferably extends from a lengthwise portion of the support pad 20 and upon an outer side of the support pad 20 with respect to the propane tank 12 so that the identifier portion 40 is easily viewable when the present invention is in use. The identifier portion 40 allows an owner of the support pad 20 or propane tank 12 to label the support pad 20 or with their name, company name or other identifying mark. A further benefit of the identifier portion 40 is that any marking or labeling identifying an owner of the present invention is always in the same spot so another individual does not have to examine the entire support pad 20 to find out who is the owner of the respective propane tank 12 support system.

The identifier portion 40 preferably protrudes outwardly from the tapered portion 22 of the base portion 21 and is comprised of a triangular cross-sectional shaped configuration to include both a vertical portion 42 and a horizontal portion 43. It is appreciated that an individual may mark either or both the vertical portion 42 or the horizontal portion 43 with various identifying marks in various manners, such as but not limited to scribing the identifying mark upon the horizontal portion 43 or vertical portion, melting upon, writing upon or various other manners.

The horizontal portion 43 also may receive and secure an identifier plate 48 (i.e. nameplate). The horizontal portion 43 includes a first retaining member 45 and a second retaining member 46 extending upwardly from opposing ends of the horizontal portion 43. The first retaining member 45 and the second retaining member 46 receive opposing end holes 49 of the nameplate 48 so the nameplate 48 may rest upon the horizontal portion 43.

Once the first retaining member 45 and the second retaining member 46 are extended through the holes 49 of the nameplate 48, the first retaining member 45 and the second retaining member 46 are preferably melted so as to deform and spread over and around the holes 49. The melted retaining members are then allowed to dry and subsequently secure the nameplate 48 to the identifier portion 40. It is appreciated that various other types of adhesives may be utilized to secure the identifier plate 48 to the identifier portion 40.

E. Internal Ribbing Structure

The support pad 20 includes the internal ribbing structure 50 spread throughout the internal cavity 25 of the support pad 20. The internal ribbing structure 50 is preferably comprised of an interlocking structure and preferably distributes the weight placed upon the platform 30 to the opposing ends of the support pad 20 so as to prevent the support pad 20 from sagging or bending at the longitudinal center. The internal ribbing structure 50 is designed to distribute the weight of the propane tank 12 to the outer ends of the support pad 20 and internal ribbing structure 50 to keep the center of the support pad 20 from bending or sagging. The internal ribbing structure 50 is further attached to the underside of the platform 30 all along the internal ribbing structure 50.

The internal ribbing structure 50 is preferably molded within the internal cavity 25 and is comprised of a durable and strong material so as to withstand large amounts of weight without deforming. The internal ribbing structure 50 preferably includes a pair of first outer ribbing portions 52 upon opposing sides of the internal ribbing structure 50, a pair of second outer ribbing portions 54 on opposing sides of the internal ribbing structure 50 and an inner ribbing portion 53 interconnecting the first outer ribbing portions 52.

The inner ribbing portion 53 transfers weight and distributes the weight between the outer ribbing portions 52, 54. The inner ribbing portion 53 is preferably comprised of a less dense structure (i.e. ribs less compacted together) than the outer ribbing portions 52, 54. The inner ribbing portion 53 further preferably only includes a majority of longitudinal ribs 58 and singular cross rib 59, wherein the cross rib 59 extends across the longitudinal center (in an interlocking manner) of the longitudinal ribs 58.

The longitudinal ribs 58 of the inner ribbing portion 53 extend all the way along the internal ribbing structure 50 from one end of the internal cavity 25 to the other. The blocks formed within the inner ribbing portion 53 between the longitudinal ribs 58 and the cross ribs 59 are preferably approximately 7.5 inches in length and 3.5 inches in width for an individual area of 26.25 inches.

The internal ribbing structure 50 also preferably includes a plurality of angled supports 51 adjacent the inner ribbing portion 53. The angled supports 51 also preferably interconnect the inner surface of the platform 30 with the inner surface of the tapered portion 22 of the support pad 20 within the internal cavity 25.

The first outer ribbing portions 52 are preferably comprised of a denser structure (i.e. more ribs compacted together) than the inner ribbing portion 53, wherein the first outer ribbing portions 52 must withstand a majority of the amount of weight placed upon the support pad 20. The first outer ribbing portions 52 also include a plurality of interlocking ribs (i.e. longitudinal ribs 58 and cross ribs 59). It is appreciated that some but not all of the longitudinal ribs 58 extending along the first outer ribbing portion 52 extend across the inner ribbing portion 53. The blocks formed within the first outer ribbing portions 52 between the longitudinal ribs 58 and the cross ribs 59 are preferably approximately 1.625 inches in length and 1.875 inches in width for an individual area of 3.05 inches.

The first outer ribbing portions 52 are also preferably positioned directly below and aligned with the respective receiving portions 37 and are also attached to the underside of the receiving portions 37. The first outer ribbing portions 52 are preferably comprised of the densest structure of the internal ribbing structure 50, wherein the first outer ribbing portions 52 receive a majority of the weight of the propane tank 12.

The second outer ribbing portions 54 are preferably comprised of a denser structure (i.e. more ribs compacted together) than the inner ribbing portion 53. The second outer ribbing portions 54 are also preferably comprised of a less dense structure than the first outer ribbing portions 52. The second outer ribbing portions 52 also include a plurality of longitudinal ribs 58 and is defined by a cross rib 59 of the first outer ribbing portion 52 and the end wall of the internal cavity 25.

It is appreciated that some but not all of the longitudinal ribs 58 extending along the second outer ribbing portion 52 extend across the inner ribbing portion 53, wherein the remainder of the longitudinal ribs 58 that don't extend within the inner ribbing portion 53 extend within the first outer ribbing portion 52. The blocks formed within the second outer ribbing portions 54 between the longitudinal ribs 58 and the cross ribs 59 are preferably approximately 3.5 inches in length and 1.875 inches in width for an individual area of 6.56 inches. The second outer ribbing portions 52 are also preferably positioned directly below and aligned with the outer guide ridges 35.

Each intersecting rib of the internal ribbing structure 50 may also include a support 55 at the intersection of the rib 58, 59. The support 55 is preferably positioned upon the bottom of the interlocking rib 58, 59 of the internal ribbing structure 50. The support 55 contacts the base plate 60, wherein the base plate 60 is pushed up against the supports 55 of the internal ribbing structure 50 within the cavity 25 when assembled. The supports 55 at the intersection of the internal ribbing structure 50 preferably increase the surface area of the intersecting ribs to better distribute the weight of the propane tank 12 upon the base plate 60. The supports 55 may be comprised of various shapes, such as but not limited to circular.

The support pad 20 also preferably includes a plurality of support tabs 56 extending from the perimeter of the base portion 21 at a lower end of the internal cavity 25. The support tabs 56 contact the base plate 60, wherein the base plate 60 is pushed up against the support tabs 56 when assembled. The support tabs 56 may be comprised of various shapes, such as but not limited to rectangular. The supports 55 and support tabs 56 preferably prevent the base plate 60 from caving within the internal cavity 25.

A plurality of mounting tabs 57 also extend inwardly from the perimeter of the base portion 21 at a lower end of the internal cavity 25. The mounting tabs 57 preferably each include openings extending through to receive the fasteners 69 that are utilized to attach the base plate 60 to the support pads 20. The openings of the mounting tabs 57 thus preferably align with the apertures 62 of the base plate 60.

F. Base Plate

The present invention also includes a base plate 60 that is preferably removably attached to the support pad 20. The base plate 60 forms the bottom of the support pad 20 to prevent dirt or other material from entering within the internal cavity 25 and also to better distribute the weight of the propane tank 12 over the entire surface area of the base plate 60. The base plate 60 is preferably removable to allow for easier manufacture of the present invention and also to allow access to the internal cavity 25.

It is appreciated however that the base plate 60 may be integrally formed with the support pad 20 in alternate configurations of the present invention. The base plate 60 includes a plurality of apertures 62 extending through the base plate 60 and following a perimeter of the base plate 60. The apertures 62 preferably align with the openings of the mounting tab 57, wherein the apertures 62 and the mounting tab 57 preferably threadably receive a fastener 69 (e.g. screws) to attach the base plate 60 to the support pad 20.

It is appreciated that when attaching the base plate 60 to the support pad 20, the upper surface of the base plate 60 is positioned evenly against the supports 55, the support tabs 56 and the mounting tabs 57. The lower surface of the base plate 60 is preferably flush with the lower end of the base portion 21. The base plate 60 may also include a series of notches 64 extending within the base plate 60 to allow for drainage of any water that may have entered the internal cavity 25 of the support pad 20.

G. Operation of Preferred Embodiment

In use, the present invention is first assembled by attaching the base plate 60 to the support pad 20. Two of the propane tank 12 support systems are now positioned parallel with each other and at a distance from each other equal to the distance between opposing end legs 13 of the propane tank 12 to be utilized. The propane tank 12 support systems are ensured to be stabilized upon the ground.

The propane tank 12 is now positioned upon the propane tank 12 support systems by positioning the legs 13 of the propane tank 12 within a respective receiving portion 37 of a respective platform 30. Each respective propane tank 12 support system is now able to distribute the weight of the propane tank 12 among the internal ribbing structure 50. It is appreciated that the owner may also mark their respective support pad 20 upon the identifier portion 40.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A horizontal fuel tank support system, comprising:

a support pad including an internal cavity, wherein said internal cavity extends throughout said support pad and wherein said support pad is comprised of an elongated configuration;

a platform defining at least a portion of an upper surface of said elongated support pad, wherein said platform extends along a longitudinal axis of said elongated support pad;

an internal ribbing structure extending within said internal cavity and beneath said platform;

wherein said internal ribbing structure includes a plurality of outer ribbing portions and an inner ribbing portion, wherein said inner ribbing portion is connected between said plurality of outer ribbing portions;

wherein said inner ribbing portion is comprised of a less dense structure than said plurality of outer ribbing portions;

wherein said plurality of outer ribbing portions includes a pair of first outer ribbing portions and a pair of second outer ribbing portions;

wherein said pair of second outer ribbing portions are less dense than said pair of first outer ribbing portions;

wherein said pair of first outer ribbing portions are more dense than said inner ribbing portion;

wherein said pair of second outer ribbing portions are more dense than said inner ribbing portion;

a plurality of support tabs, wherein said plurality of support tabs extend within an internal cavity of said support pad from a perimeter of said support pad;

a plurality of supports extending from an intersection of a plurality of longitudinal ribs and a plurality of cross ribs of said internal ribbing structure;

wherein said plurality of supports are comprised of a circular shaped configuration;

a plurality of angled supports extending within said internal cavity;

wherein said plurality of angled supports connect said platform to a sidewall of said support pad;

a plurality of guide ridges extending vertically upward from said platform, wherein said plurality of guide ridges extend across said platform; and a pair of receiving portions defined by said plurality of guide ridges, wherein said pair of receiving portions are comprised of a planar configuration;

wherein said plurality of guide ridges include a plurality of outer guide ridges;

wherein said plurality of guide ridges include a plurality of inner guide ridges;

wherein said pair of receiving portions are defined between said plurality of inner guide ridges and said plurality of outer guide ridges;

wherein said plurality of outer guide ridges include one outer guide ridge upon each end of said platform;

wherein said plurality of outer guide ridges and said plurality of inner guide ridges are comprised of an X-shaped configuration.

2. A support structure having internal ribbing, comprising:

a support pad having an elongated internal cavity extending throughout;

a platform defining an upper surface of said elongated support pad, wherein said platform has a pair of defined receiving portions, each said defined receiving portion adjacent a respect longitudinal end;

an internal ribbing structure extending throughout said internal cavity of said support pad and beneath said platform;

wherein said internal ribbing structure has a plurality of ribbing portions including an inner ribbing portion, a pair of first outer ribbing portions, and a pair of second outer ribbing portions, each of said plurality of ribbing portions arranged linearly one-after another along a longitudinal axis of said internal ribbing structure such that said inner ribbing portion is centrally located along said longitudinal axis, said pair of first outer ribbing portions extend outwardly from opposing ends of said inner ribbing portion along said longitudinal axis, and said pair of second outer ribbing portions extend outwardly from said pair of first outer ribbing portions along said longitudinal axis;

wherein said inner ribbing portion is located centrally between said pair of defined receiving portions, said pair of first outer ribbing portions are positioned vertically beneath said pair of defined receiving portions, and said pair of second outer ribbing portions are positioned outwardly from said pair of defined receiving portions, such that said pair of first outer ribbing portions are vertically aligned with said pair of defined receiving portions and such that said inner ribbing portion and said pair of second outer ribbing portions are not vertically aligned with said pair of defined receiving portions;

wherein said inner ribbing portion is less dense than said pair of second outer ribbing portions and wherein said pair of second outer ribbing portions are less dense than said pair of first outer ribbing portions; and a base plate connected to said support pad, said base plate covers a bottom of said internal cavity to enclose said internal ribbing structure within said internal cavity.

3. The support structure of claim 2, including a plurality of support tabs, wherein said plurality of support tabs extend within said internal cavity of said support pad from a perimeter of said support pad.

4. The support structure of claim 2, including a plurality of supports extending from an intersection of a plurality of longitudinal ribs and a plurality of cross ribs of said internal ribbing structure.

5. The support structure of claim 4, wherein each of said plurality of supports comprises a circular shaped structure.

6. The support structure of claim 2, including a plurality of angled supports extending within said internal cavity.

7. The support structure of claim 6, wherein said plurality of angled supports connects said platform to a sidewall of said support pad.

8. The support structure of claim 2, wherein said pair of defined receiving portions are defined by a plurality of guide ridges extending vertically upward from said platform.

9. The support structure of claim 8, wherein each of said plurality of guide ridges comprises an X-shaped structure.

10. The support structure of claim 8, wherein said plurality of guide ridges includes a plurality of outer guide ridges and at least one inner guide ridge.

11. The support structure of claim 10, wherein said pair of defined receiving portions are defined between said at least one inner guide ridge and said plurality of outer guide ridges.

12. The support structure of claim 11, wherein said at least one inner guide ridge is vertically aligned with said inner ribbing portion and wherein said plurality of outer guide ridges are vertically aligned with said pair of second outer ribbing portions.

13. The support structure of claim 8, including a raised edge extending vertically upwards from an entire peripheral edge of said platform such as to surround said plurality of guide ridges.

* * * * *